US011262705B2

(12) United States Patent
Tamura et al.

(10) Patent No.: US 11,262,705 B2
(45) Date of Patent: Mar. 1, 2022

(54) MOVEMENT AND TIMEPIECE

(71) Applicant: Seiko Epson Corporation, Tokyo (JP)

(72) Inventors: Shuichi Tamura, Matsumoto (JP); Tsunenobu Endo, Matsumoto (JP)

(73) Assignee: Seiko Epson Corporation

( * ) Notice: Subject to any disclaimer, the term of this patent is extended or adjusted under 35 U.S.C. 154(b) by 446 days.

(21) Appl. No.: 16/285,616

(22) Filed: Feb. 26, 2019

(65) Prior Publication Data

US 2019/0265653 A1 Aug. 29, 2019

(30) Foreign Application Priority Data

Feb. 27, 2018 (JP) ..... JP2018-033846

(51) Int. Cl.

| | |
|---|---|
| ***G04B 13/02*** | (2006.01) |
| ***G04C 3/00*** | (2006.01) |
| ***G04C 3/14*** | (2006.01) |

(52) U.S. Cl.

CPC ..... *G04C 3/008* (2013.01); *G04C 3/14* (2013.01); *G04C 3/146* (2013.01); *G04B 13/02* (2013.01)

(58) Field of Classification Search

CPC ..... G04B 13/02; G04B 19/02; G04C 3/14; G04C 3/146; G04C 3/008

See application file for complete search history.

(56) References Cited

U.S. PATENT DOCUMENTS

| | | | | |
|---|---|---|---|---|
| 4,351,043 | A * | 9/1982 | Ogihara | G04C 21/20 368/252 |
| 5,369,627 | A * | 11/1994 | Ikegami | B23P 15/14 368/220 |
| 2002/0167869 | A1 | 11/2002 | Masuda et al. | |
| 2006/0164925 | A1 | 7/2006 | Endo et al. | |
| 2018/0217561 | A1 | 8/2018 | Isshiki et al. | |
| 2018/0341677 | A1 | 11/2018 | Fan et al. | |

FOREIGN PATENT DOCUMENTS

| | | | |
|---|---|---|---|
| CN | 101549543 | A | 10/2009 |
| CN | 107621775 | A | 1/2018 |
| JP | S63-017032 | A | 1/1988 |
| JP | 03-081370 | A | 4/1991 |
| JP | 2003-255061 | A | 9/2003 |
| JP | 2006-337127 | A | 12/2006 |
| WO | WO-03-054636 | A1 | 7/2003 |
| WO | 2017-207300 | A1 | 12/2017 |

OTHER PUBLICATIONS

U.S. Appl. No. 16/285,481, filed Feb. 26, 2019, Shuichi Tamura et al.

* cited by examiner

*Primary Examiner* — Sean Kayes
(74) *Attorney, Agent, or Firm* — Harness, Dickey & Pierce, P.L.C.

(57) ABSTRACT

A movement includes a first wheel which includes a wheel main body which is configured by a resin material and a metal layer which is configured by a metal material and is provided on an outer surface of the wheel main body, and a second wheel which is configured by a metal material, in which the movement transmits a drive force of an electric motor module which is driven using a battery as an electrical power source.

10 Claims, 8 Drawing Sheets

MOVEMENT AND TIMEPIECE

BACKGROUND

1. Technical Field

The present invention relates to a movement and a timepiece.

2. Related Art

For example, there is known a timepiece in which a battery is embedded and which performs notification of a time by causing a pointer such as a second hand to rotate using the electrical power of the battery. The movement of the timepiece includes a train wheel unit which drives the pointer and a drive motor. The train wheel unit includes, for example, a first wheel which meshes with a wheel of the drive motor and a second wheel to which the pointer is fixed. A rotational force of the drive motor is transmitted to the second wheel via the first wheel. Accordingly, the pointer rotates.

The first wheel is configured by a resin material which is a comparatively light material in order to suppress a moment of inertia. Meanwhile, since a hand is fixed to the second wheel, the second wheel is configured by a metal material which is a sufficiently strong material. The train wheel unit is configured to hold the positions of the wheels using a main plate and a train wheel bridge which hold the axles of each of the first wheel and the second wheel from both sides.

The first wheel and the second wheel are thin and the distance between the main plate and the train wheel bridge is short. The main plate and the train wheel bridge are configured by a resin material which is a comparatively light material.

In the train wheel unit, in a case in which the first wheel which is configured by a resin material and the second wheel which is configured by a metal material mesh with each other to rotate together, static electricity is generated between the first wheel and the second wheel at times such as when there is friction between the teeth of both wheels and when the teeth which mesh with each other separate from each other. When this phenomenon occurs, due to a charge which is accumulated in the wheels, the main plate and the train wheel bridge which are close to the side surfaces of the wheels polarize easily, and the wheels stick to the train wheel bridge and the frictional resistance greatly rises due to a Coulomb force which is generated between the wheels and the train wheel bridge which has a particularly close distance to the wheels. A problem in that the electric motor module stops occurs depending on the degree of the rise in frictional resistance.

In order to discharge the charge that is accumulated in the wheels, it is important that the electrical resistance of the resin material is low. Therefore, in the related art, there is proposed a technique which is disclosed in JP-A-3-081370, for example, for reducing the electrical resistance of the resin material. In the device which is disclosed in JP-A-3-081370, carbon fibers are mixed into a resin material of a wheel. Pamphlet of International Publication WO 2003/54636 proposes a technique which uses a substrate which is configured by a resin material and a wheel in which carbon fibers and boron are mixed into a resin material.

However, there is a problem in that, since the carbon fibers described in JP-A-3-081370 and Pamphlet of International Publication WO 2003/54636 do not reach the tooth tips of the wheel, sufficient conductivity may not be obtained.

SUMMARY

An advantage of some aspects of the invention is to provide a movement and a timepiece which are capable of securing sufficient conductivity.

A movement according to an aspect of the invention includes an electric motor module which is driven by electrical power of a battery, a first wheel which transmits a drive force of the electric motor module and includes a wheel main body which is configured by a resin material and a metal layer which is configured by a metal material and is provided on a surface of the wheel main body, and a second wheel which transmits the drive force of the electric motor module and is configured by a metal material.

According to this configuration, it is possible to sufficiently secure the conductivity of the first wheel using a metal layer which is configured by a metal material. It is possible to effectively suppress the static electricity caused by the friction which is generated when the first wheel and the second wheel mesh and rotate together. It is possible to discharge the static electricity which is generated by the separating of the first wheel and the second wheel by electrically connecting the first wheel and the second wheel to a structural body having a sufficiently large electrostatic capacity with respect to the static electricity which is generated in the first wheel and the second wheel such as an electrode (the cathode or the anode) of a drive motor electrical power source or the external case, for example.

It is preferable that the movement according to the aspect of the invention further includes a train wheel bridge which supports the first wheel and the second wheel and is conductive.

With this configuration, it is possible to render the train wheel bridge, the first wheel, and the second wheel the same potential. Accordingly, it is possible to prevent the generation of not only the Coulomb force between the first wheel, the second wheel, and the train wheel bridge, but also a Johnson Rahbeck force and a gradient force. As a result, it is possible to more effectively prevent problems such as the electric motor module which drives the first wheel and the second wheel stopping.

It is preferable that the movement according to the aspect of the invention further includes a main plate which supports the first wheel and the second wheel and is conductive.

With this configuration, it is possible to render the main plate, the first wheel, and the second wheel the same potential. Accordingly, it is possible to prevent the generation of not only the Coulomb force between the first wheel, the second wheel, and the main plate, but also a Johnson Rahbeck force and a gradient force. As a result, it is possible to more effectively prevent problems such as the electric motor module which drives the first wheel and the second wheel stopping.

In the movement according to the aspect of the invention, the metal material preferably includes at least a material selected from nickel, tin, and chrome.

With this configuration, the first wheel has excellent abrasion resistance while securing sufficient conductivity.

In the movement according to the aspect of the invention, it is preferable that the first wheel meshes with the second wheel.

In a case in which the first wheel and the second wheel mesh with each other, although static electricity is easily generated in the first wheel, even in this case, the effect of the invention is more effectively exhibited.

In the movement according to the aspect of the invention, it is preferable that the wheel main body includes teeth, and that the metal layer is provided on a tooth surface of the teeth to cover a portion thereof.

With this configuration, the metal layer and the second wheel are capable of contacting each other, for example, it is possible to discharge the static electricity which is generated by the first wheel via the second wheel.

In the movement according to the aspect of the invention, it is preferable that the wheel main body includes a main surface, and that the metal layer is provided on the main surface of the wheel main body.

With this configuration, it is possible to effectively discharge still more static electricity which is generated by the first wheel.

In the movement according to the aspect of the invention, it is preferable that the first wheel meshes with a wheel which is fixed to a rotating axle of the electric motor module.

With this configuration, the first wheel is lightened and it is possible to suppress the moment of inertia of the first wheel.

The movement according to the aspect of the invention may include a plurality of the first wheels which mesh with each other.

In a case in which the train wheel unit includes a plurality of the conductive first wheels, it is possible to discharge the plurality of first wheels by connecting one of the plurality of first wheels to a grounding electrode.

In the movement according to the aspect of the invention, it is preferable that the second wheel is positioned closer to a following side than the first wheel.

According to this configuration, although the second wheel is easily influenced by torque as compared to the first wheel, since the second wheel is configured by a metal material, the strength is high and the resilience is excellent.

In the movement according to the aspect of the invention, it is preferable that a second hand is fixed to the second wheel.

In the train wheel unit which drives the second hand, since a configuration is adopted in which the rotation speeds of the wheels are comparatively fast and static electricity is easily accumulated, the effect of the invention is more effectively exhibited.

A timepiece according to another aspect of the invention includes the movement described above and a casing which stores the movement.

With this configuration, the timepiece which exhibits the effect may be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a detailed description will be given of a movement and a timepiece according to the invention based on favorable embodiments which are illustrated in the appended drawings.

First Embodiment

Figure 1:
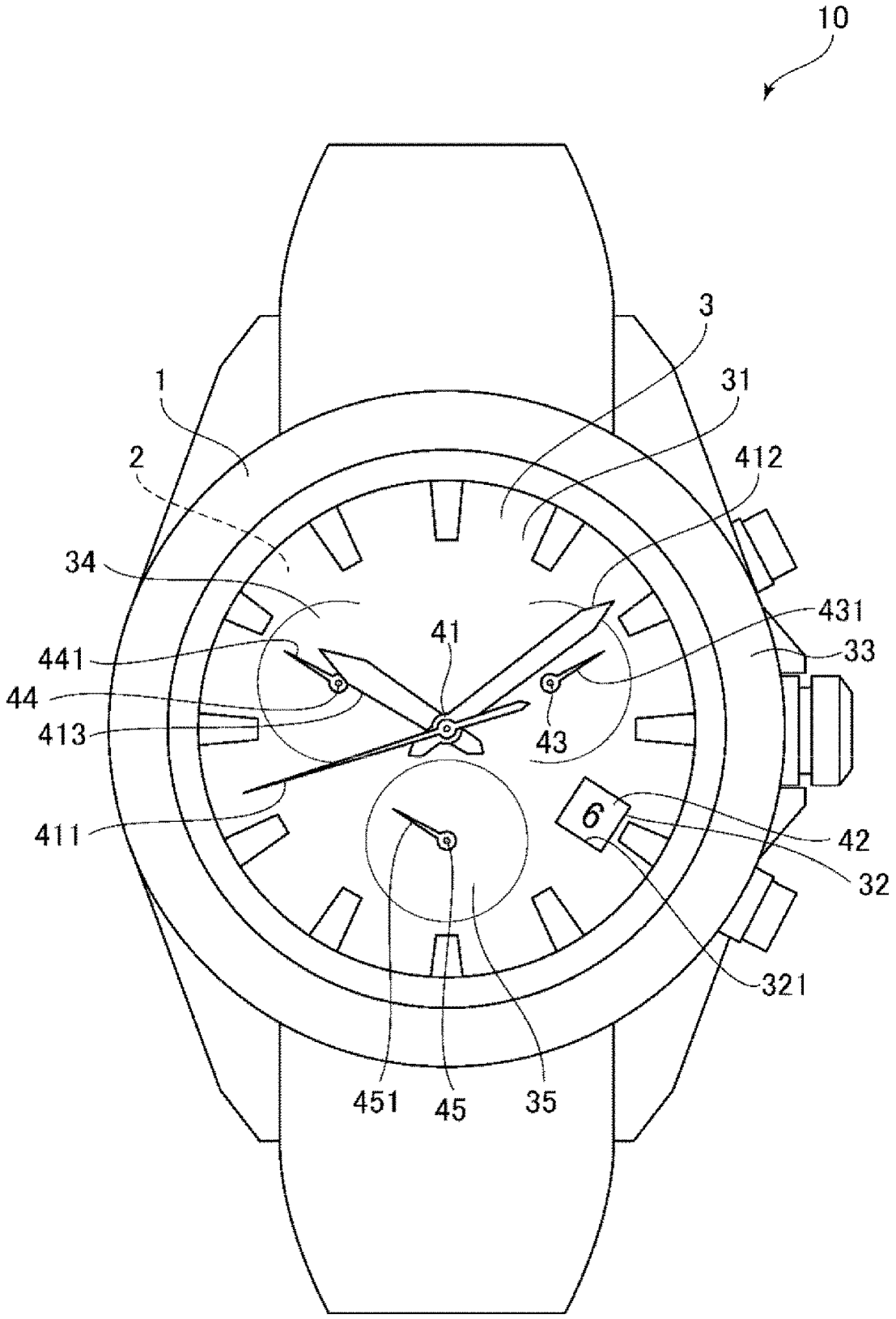
FIG. 1 is a front view of a timepiece of a first embodiment.
Figure 2:
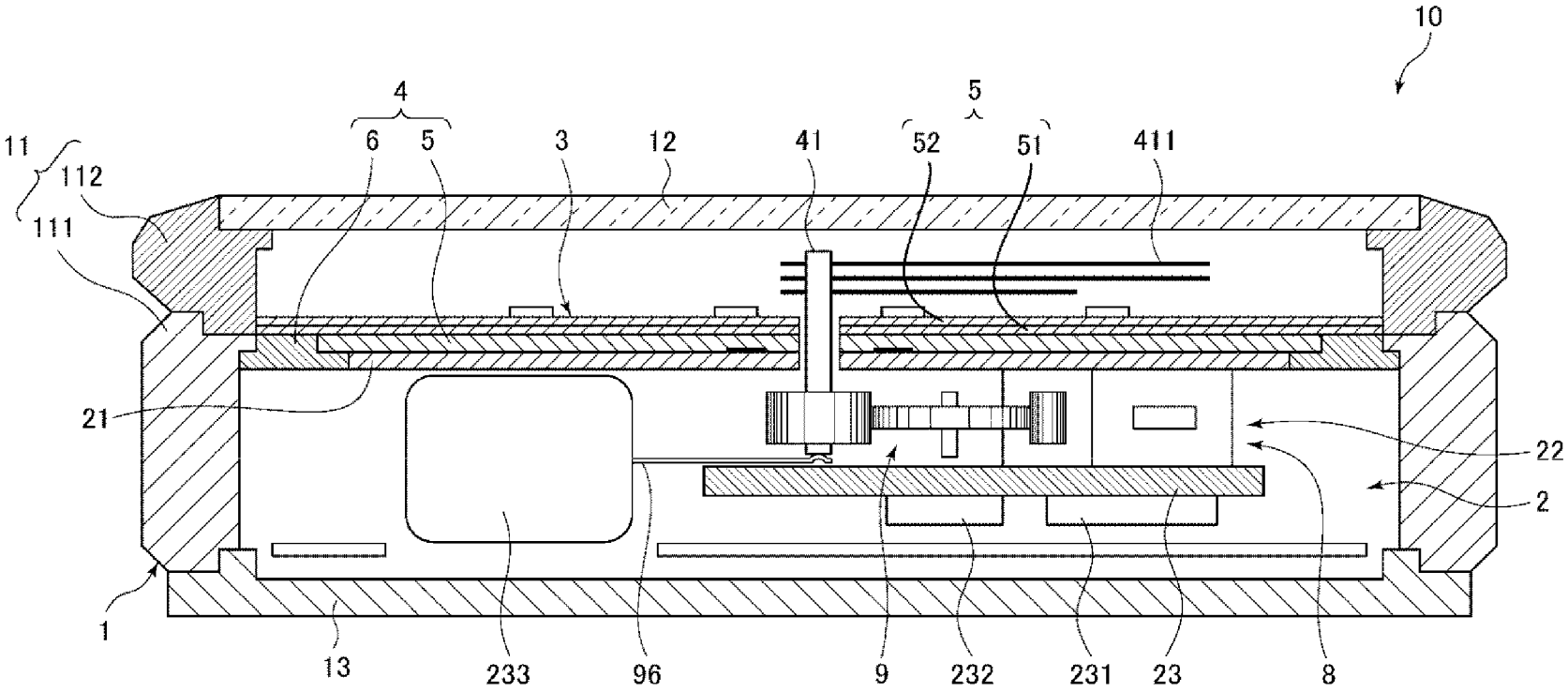
FIG. 2 is a sectional diagram of the timepiece illustrated in FIG. 1.
Figure 3:
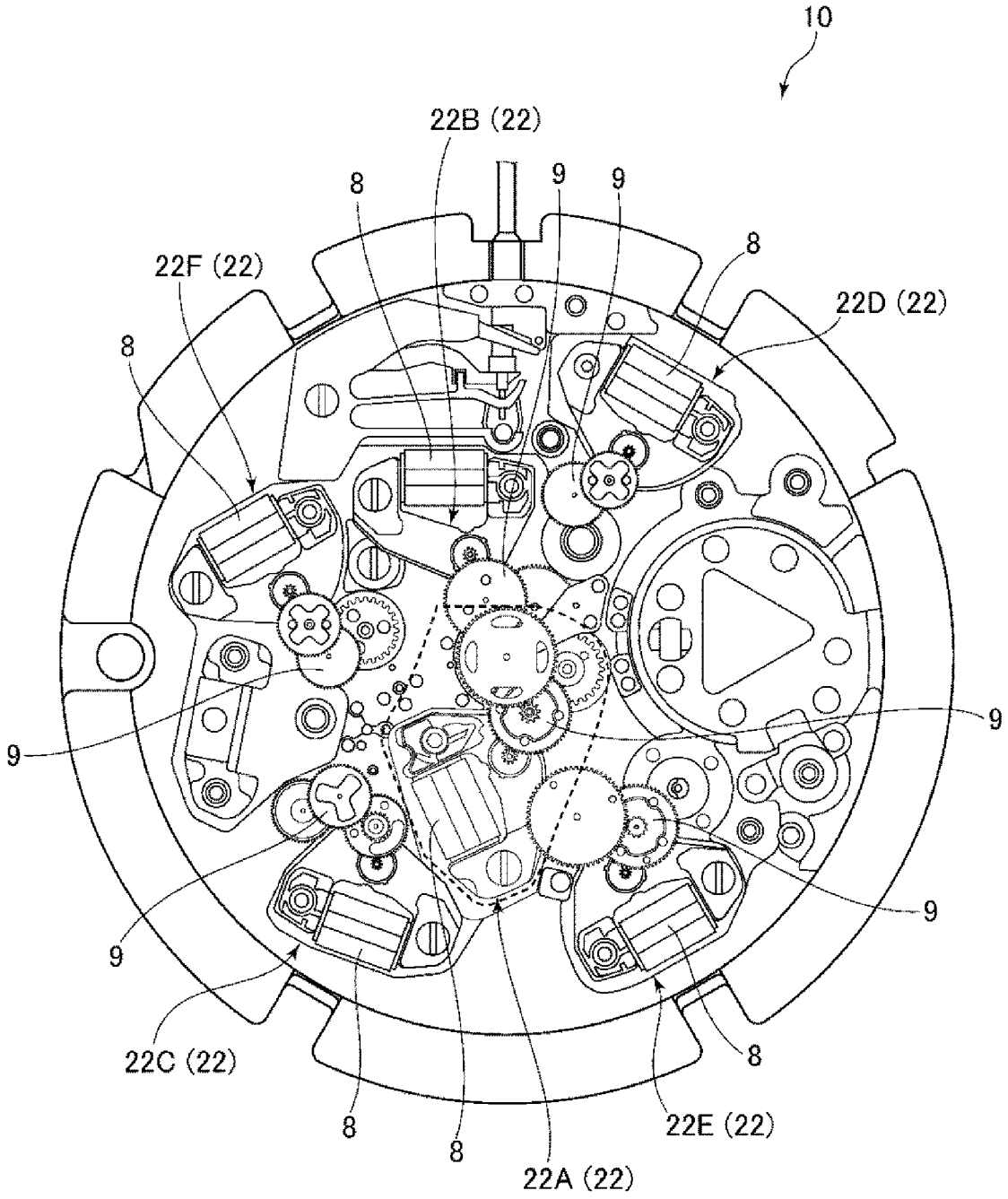
FIG. 3 is a plan view of a movement which is included in the timepiece illustrated in FIG. 1.
Figure 4:
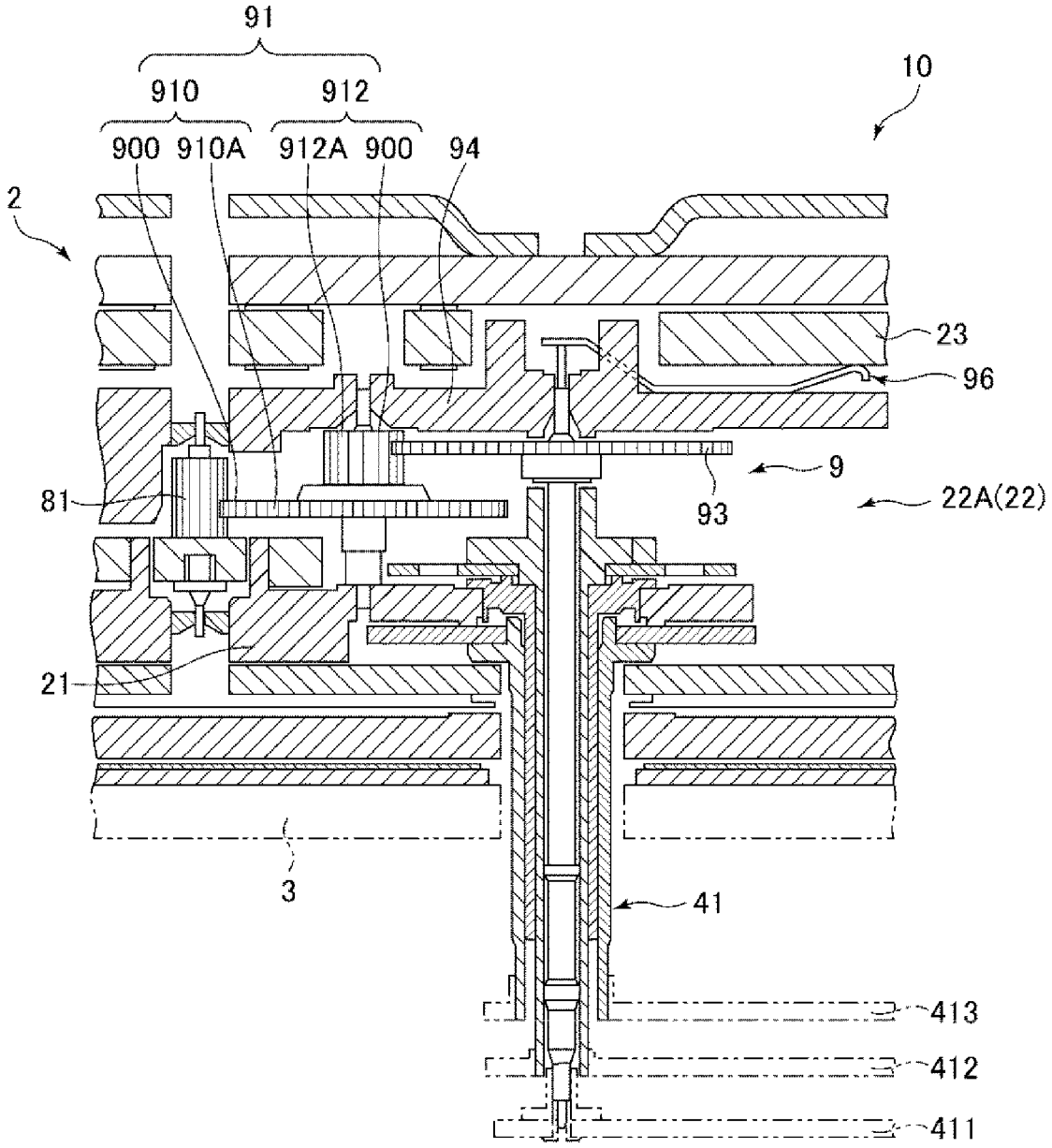
FIG. 4 is an enlarged sectional diagram of the movement which is included in the timepiece illustrated in FIG. 1.
Figure 5:
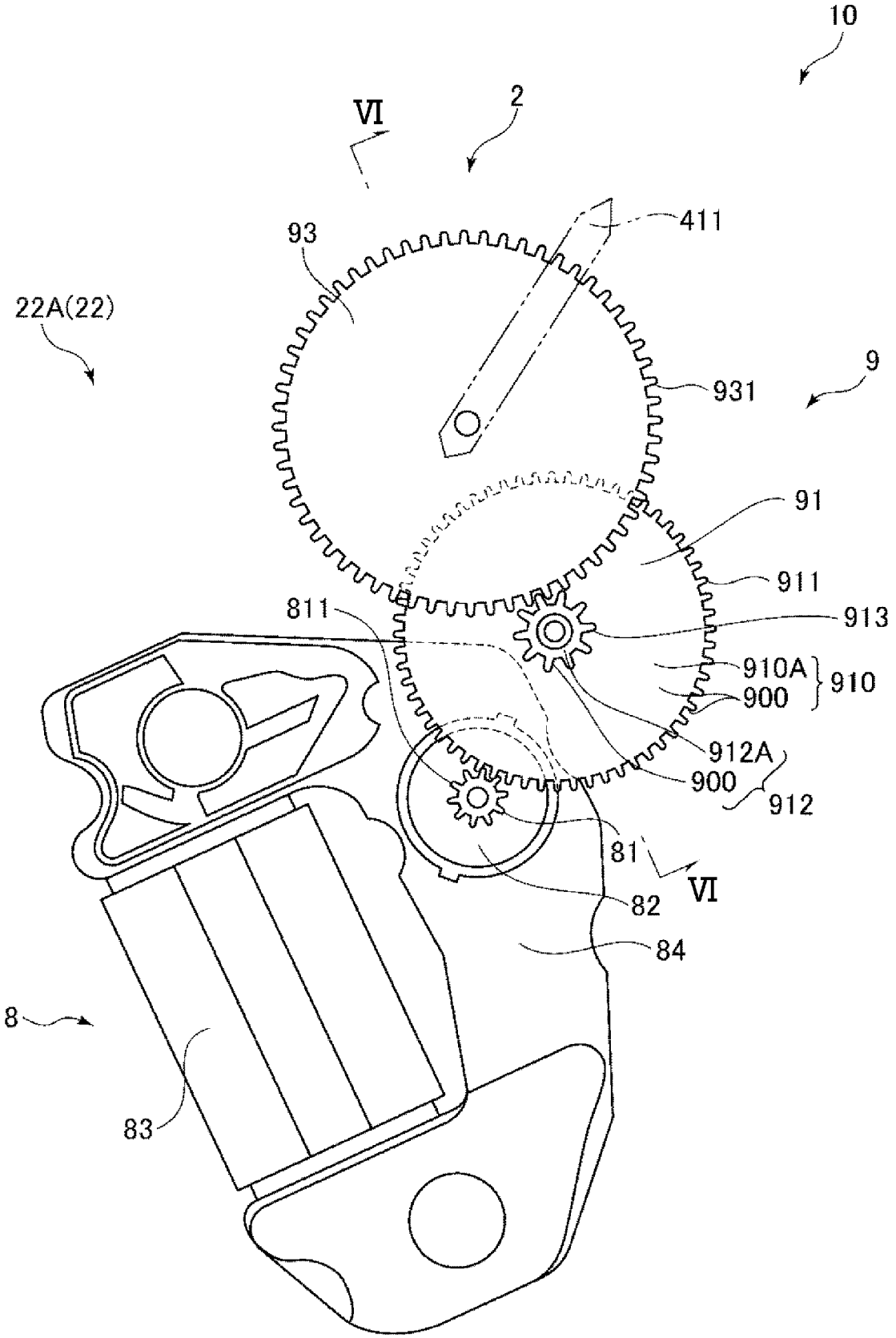
FIG. 5 is a schematic diagram (a plan view) illustrating a train wheel unit in FIG. 3.
Figure 6:
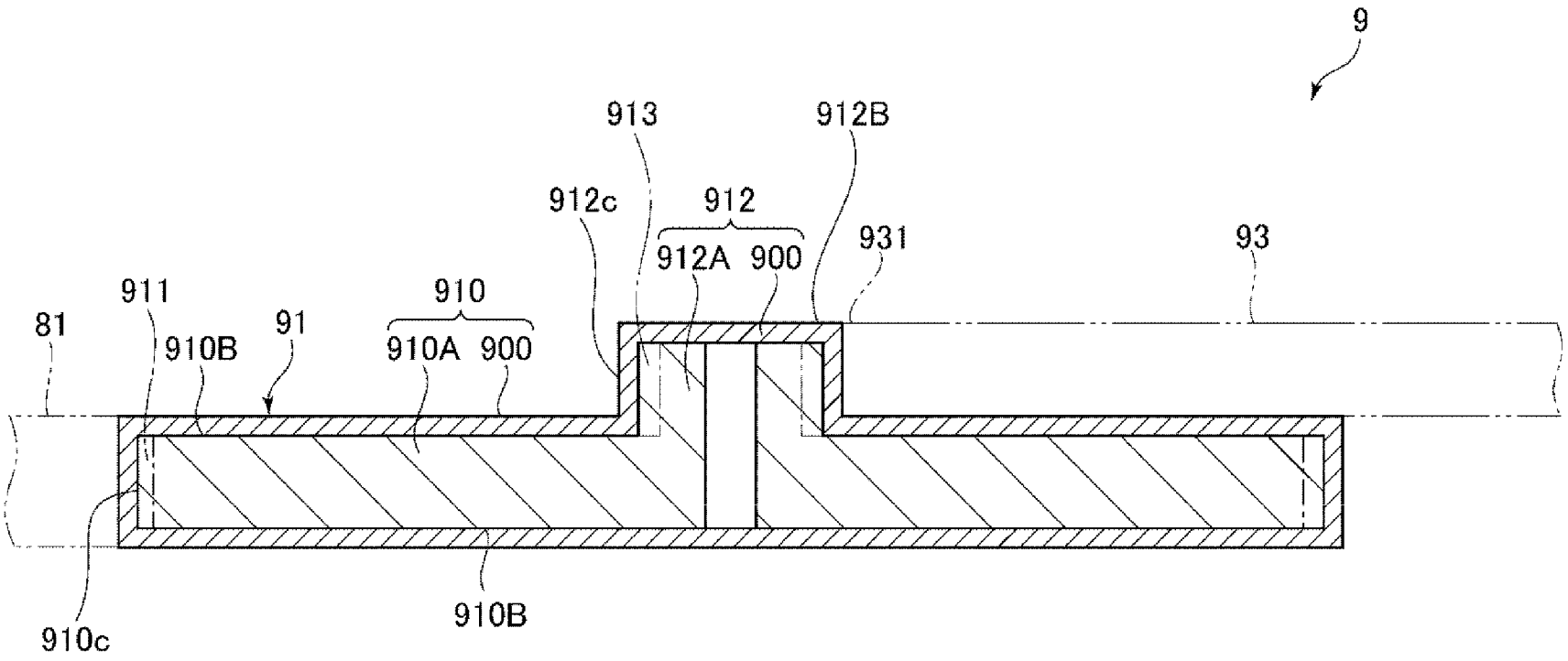
FIG. 6 is a sectional diagram taken along the line A-A of FIG. 5.

FIG. 1 is a front view of an electronic timepiece which is a timepiece of a first embodiment. FIG. 2 is a sectional diagram of the timepiece illustrated in FIG. 1. FIG. 3 is a plan view of a movement which is included in the timepiece illustrated in FIG. 1. FIG. 4 is an enlarged sectional diagram of the movement which is included in the timepiece illustrated in FIG. 1. FIG. 5 is a schematic diagram (a plan view) illustrating a train wheel unit in FIG. 3. FIG. 6 is a sectional diagram taken along the line A-A of FIG. 5.

Hereinafter, a description will be given of an embodiment of the movement and the timepiece according to the invention with reference to FIGS. 1 to 6. The dial side is also referred to as "up" or "an obverse side", and a rear cover side is also referred to as "down" or "a reverse side".

As illustrated in FIGS. 1 and 2, an electronic timepiece 10 is provided with a housing 1, a movement 2, a dial 3, and an electrical power generating unit 4. A pair of belts is provided on the outer edge of the housing 1 and it is possible to wear the electronic timepiece 10 on an arm.

The housing 1 is provided with an external case 11, a cover glass 12, and a rear cover 13. In the external case 11, a bezel 112 which is formed of a ceramic, for example, is fitted into a cylindrical case 111 which is formed by a metal. The dial 3 is disposed in the inner circumferential portion of the bezel 112 as a time display portion.

The movement 2 is provided with a main plate 21, a drive mechanism 22 which is supported by the main plate 21, and a printed circuit board 23.

The main plate 21 has a function of supporting the drive mechanism 22 and the like. The main plate 21 is attached to a support member 6 (described later).

The drive mechanism 22 is mainly attached to the surface on the bottom side (the rear cover side) of the main plate 21. A detailed description will be given of the drive mechanism 22 later.

The printed circuit board 23 covers the reverse side of the drive mechanism 22. The printed circuit board 23 is provided with a receiving unit (a GPS module) 231, a control unit 232, and a battery 233. The battery 233 is configured by a secondary battery such as a lithium ion battery, a silver oxide battery, or the like. In the present embodiment, the battery 233 is charged by the electrical power which is generated by a solar cell 5 (described later). The printed circuit board 23 is connected to an antenna (not illustrated) via a connection pin. The printed circuit board 23 is covered from the reverse side by a conductive circuit retainer 25.

As illustrated in FIG. 1, the dial 3 includes a time display portion 31, a calendar display portion 32, a day display portion 33, a multi-indicator 34, and a dual-time display portion 35.

A pointer axle 41 is inserted through the time display portion 31. The pointer axle 41 has a three-layer cylindrical structure which is provided concentrically, for example, and a hand 411 which is the second hand, a hand 412 which is the minute hand, and a hand 413 which is the hour hand are fixed to each axle to rotate independently.

The calendar display portion 32 has a function of performing notification of the date by a portion of a calendar wheel 42 being displayed via a window portion 321 which is provided in the dial 3. The numbers 1 to 31 are printed on the calendar wheel 42.

A pointer axle 43 is inserted through the day display portion 33 which has a function of performing notification of the day of the week according to a position indicated by a hand 431 which is fixed to the pointer axle 43.

A pointer axle 44 is inserted through the multi-indicator 34 which has a function of performing notification of an electrical power remaining amount of the battery 233, for example, according to a position indicated by a hand 441 which is fixed to the pointer axle 44.

A pointer axle 45 is inserted through the dual-time display portion 35 which has a function of performing notification of the time of another country, for example, according to a position indicated by a hand 451 which is fixed to the pointer axle 45.

The pointer axle 41 is driven by drive mechanisms 22A and 22B (described later). Specifically, the hand 411 is driven by the drive mechanism 22A, and the hand 412 and the hand 413 are driven by the drive mechanism 22B. The calendar wheel 42 is driven by a drive mechanism 22C (described later), the pointer axle 43 is driven by a drive mechanism 22D (described later), the pointer axle 44 is driven by a drive mechanism 22E (described later), and the pointer axle 45 is driven by a drive mechanism 22F (described later) (refer to FIG. 3).

The dial 3 has a favorable optical transmittance in a useful wavelength band with respect to the spectral sensitivity of the solar cell 5 and is transparent, for example. The constituent materials are not particularly limited, and examples thereof include various glass materials and various plastic materials. In particular, plastic materials are preferable from the perspective of being light, easy to work, and the like, and of these, polycarbonate is favorable. In the electronic timepiece 10, the light which is transmitted through the dial 3 reaches the solar cell 5, and thus, as described earlier, an electrical power is generated.

It is preferable for the dial 3 to have a function of diffusing light. Accordingly, it is possible to prevent or to suppress the visual recognition of the solar cell 5, which is on the reverse side of the dial 3, via the dial 3. In a general wristwatch, it is preferable for the solar cell 5 not to be visually recognized from the outside, to the extent that this is possible. Ina case in which the visual recognizability of the solar cell 5 is suppressed, as in the electronic timepiece 10, the aesthetics of the electronic timepiece 10 are improved.

The method of bestowing a light-diffusing function on the dial 3 is not particularly limited, and examples of such a method include a method of forming a diffusing layer which contains a diffusing agent, a method of installing a polarization film, and a method of forming multiple minute surface irregularities which function as prisms on at least one of the surface on the obverse side of the dial 3 and the surface on the reverse side of the dial 3.

The dial 3 has a substantially circular shape in plan view. The main plate 21, the cover glass 12, and the solar cell 5 have similarly circular shapes in plan view.

As illustrated in FIG. 2, the electrical power generating unit 4 includes the solar cell 5 and the support member 6.

The solar cell 5 has a function of converting solar energy into electrical energy. The electrical energy which is converted by the solar cell 5 is used in the driving of the movement 2 and the like.

The solar cell 5 includes a substrate 51 and a solar cell film 52 which is laminated onto the substrate 51.

The substrate 51 has a function of supporting the solar cell film 52. The substrate 51 is configured by a resin material. Examples of the resin material include various thermoplastic resins and various curing resins such as heat-curing resins and light-curing resins.

The solar cell film 52 has a pin structure in which p-type impurities and n-type impurities are selectively introduced to a non-single-crystalline silicon thin film, and an i-type non-single-crystalline silicon thin film which has a low impurity concentration is provided between the p-type non-single-crystalline silicon thin film and the n-type non-single-crystalline silicon thin film.

Although not illustrated, electrodes are formed on the solar cell 5 and the electrical power which is generated by the solar cell 5 is supplied to the battery 233 via wiring which is connected to the electrodes.

As illustrated in FIG. 2, the support member 6 is disposed on the outer circumferential side of the main plate 21 on the reverse surface side of the dial 3. The support member 6 is configured by a frame-shaped member and is fixed to the solar cell 5 and the dial 3 by a fixing unit (not illustrated). The support member 6 is fixed to the main plate 21 in a state of supporting the dial 3 and the solar cell 5.

As illustrated in FIG. 3, the drive mechanism 22 includes the drive mechanism 22A and the drive mechanism 22B which drive the pointer axle 41, the drive mechanism 22C which drives the calendar wheel 42, the drive mechanism 22D which drives the pointer axle 43, the drive mechanism 22E which drives the pointer axle 44, and the drive mechanism 22F which drives the pointer axle 45.

Since the drive mechanisms have substantially the same configuration, hereinafter, a detailed description will be given of the drive mechanism 22A. The drive mechanism 22A is the portion which is surrounded by the dashed line in FIG. 3.

FIG. 4 is an enlarged sectional diagram of the vicinity of the drive mechanism 22A. FIG. 5 is a schematic diagram (a plan view) of the drive mechanism 22A. As illustrated in FIGS. 4 and 5, the drive mechanism 22A includes an electric motor module 8 and a train wheel unit 9 which is driven by the electric motor module 8.

The electric motor module 8 is a stepping motor and is provided with a stator 84, a rotor 82, a coil core, and a coil 83. The stator 84 includes a hole for accommodating the rotor, the rotor 82 is installed in the hole for accommodating the rotor to be capable of rotating, the coil core is bonded to the stator 84, and the coil 83 is wound around the coil core. The rotor 82 is provided with a rotor wheel 81.

The rotor wheel 81 is configured by a metal material, for example, and includes teeth 811 on the outer circumferential portion of the rotor wheel 81. The teeth 811 mesh with teeth 911 of a resin wheel 91. Accordingly, the rotational force of the electric motor module 8 is transmitted to the resin wheel 91 via the rotor wheel 81 of the rotor 82.

The coil 83 inside the electric motor module 8 includes terminals on both ends. Each terminal is electrically connected to the control unit 232. The rotor 82 is magnetized into two poles (an S pole and an N pole). The stator 84 is formed by a magnetic material. When a drive pulse from the control unit 232 is supplied between the terminals of both ends of the coil 83 and a current flows in the coil 83, a magnetic flux is generated in the stator 84. Accordingly, the rotor 82 rotates by one step (180°) due to the interaction between the magnetic pole which is generated in the stator 84 and the magnetic pole which is generated in the rotor 82.

The train wheel unit 9 includes the resin wheel 91, a metal wheel 93, and a train wheel bridge 94. The resin wheel 91 is a decelerating wheel which meshes with the rotor wheel 81, the hand 411 is fixed to the metal wheel 93 which meshes with the resin wheel 91, and the train wheel bridge 94 supports the resin wheel 91 and the metal wheel 93. The resin wheel 91 and the metal wheel 93 are disposed to line up in this order from the leading side.

The deceleration ratio of the train wheel unit 9 is different for each of the drive mechanisms 22A to 22F and is set to a range of approximately 5 to 100.

The resin wheel 91 includes a large wheel 910 and a small wheel 912 (a pinion) which is fixed to a center portion of one surface of the large wheel 910 and rotates coaxially with the large wheel 910. In the present embodiment, the large wheel 910 and the small wheel 912 are formed integrally.

The large wheel 910 includes a wheel main body 910A and a covering layer 900 (a metal layer) which is described later. The wheel main body 910A has a circular plate shape and includes the teeth 911 on the outer circumferential portion of the wheel main body 910A. The teeth 911 mesh with the teeth 811 of the rotor wheel 81. Accordingly, the rotational force of the rotor wheel 81 is transmitted to the resin wheel 91.

The small wheel 912 (the pinion) includes a wheel main body 912A and the covering layer 900 which is described later. The wheel main body 912A has a circular plate shape and includes the teeth 913 on the outer circumferential portion of the wheel main body 912A. The small wheel 912 meshes with the metal wheel 93.

Examples of the resin material which configures the wheel main body 910A and the wheel main body 912A include polyacetal, polycarbonate, polyamide, polyarylate, polyetherimide, and acrylonitrile-butadiene-styrene copolymer.

The metal wheel 93 has a circular plate shape and includes teeth 931 on the outer circumferential portion of the metal wheel 93. The teeth 931 mesh with teeth 913 of the small wheel 912. Accordingly, the rotational force of the resin wheel 91 is transmitted to the metal wheel 93. The hand 411 is fixed to a center portion of a top panel of the metal wheel 93.

Accordingly, the hand 411 rotates together with the rotation of the metal wheel 93.

The resin wheel 91 and the metal wheel 93 are supported by the train wheel bridge 94 from the opposite side of the main plate 21.

As illustrated in FIG. 4, a connecting unit 96 is provided between the train wheel bridge 94 and the printed circuit board 23. In the present embodiment, the connecting unit 96 is configured by a long plate spring which is conductive. One end portion (the end portion on the left side in FIG. 4) of the connecting unit 96 is in contact with the axial end of the opposite side of the dial 3 of the pointer axle 41 and the pointer axle 41 is biased in the axial direction. The other end (the end portion on the right side in FIG. 4) of the connecting unit 96 is in contact with the printed circuit board 23. The printed circuit board 23 is electrically connected to the cathode or the anode of the battery 233. Therefore, the metal wheel 93 is electrically connected to the cathode or the anode of the battery 233 via the connecting unit 96 and the printed circuit board 23. The battery 233 has a greater electrostatic capacity than the static electricity which is generated in the resin wheel 91 and the metal wheel 93.

According to the train wheel unit 9 described above, the rotational force of the electric motor module 8 is transmitted to the hand 411 via the train wheel unit 9. Since the resin wheel 91 is configured by a resin material, the resin wheel 91 is lightened and it is possible to suppress the moment of inertia of the resin wheel 91. Meanwhile, since the metal wheel 93 is configured by a metal material, it is possible to increase the strength of the metal wheel 93. Accordingly, it is possible to prevent damage to the metal wheel 93 even if the metal wheel 93 receives a torque which is generated by the rotation of the hand 411.

Incidentally, in a configuration in which the wheel which is configured by the resin material and the wheel which is configured by the metal material mesh to rotate together, static electricity is generated by the friction and the separation of both wheels and a charge is accumulated. As known from the triboelectric series, the wheel of the resin material is charged to the negative pole and the wheel of the metal material is charged to the positive pole.

Since the train wheel bridge 94 which faces both wheels is configured by a resin material, the train wheel bridge 94 is subjected to dielectric polarization by the electric field from the charge of both wheels, and a Coulomb force is generated between both wheels and the train wheel bridge 94.

Since the potentials are different between adjacent wheels, a gradient force is also generated, and since the wheels move along the axial direction, the wheels stick to the train wheel bridge 94. As a result, a frictional resistance is generated in both wheels and a problem arises in that the rotation of both wheels is impeded.

The train wheel bridge 94 is configured by a conductive material and in a case in which the train wheel bridge 94 is not grounded, a Johnson Rahbeck force is generated by the adjacent wheels having different potentials.

The train wheel bridge 94 is configured by a conductive material and even if the train wheel bridge 94 is grounded, since an image charge of the charge of the side surface of both wheels is generated in the train wheel bridge 94, a force corresponding to the Coulomb force is generated. In other words, in either case, a force works in a direction in which the wheels move along the axial direction, the wheels and the train wheel bridge 94 stick together, frictional resistance is generated, and a problem arises in that the rotation of the wheels is impeded.

In a case in which carbon fibers, carbon nanotubes, and the like which are general carbon fillers are used in rendering the wheels conductive, the longer the carbon fillers are, the better. Specifically, a length greater than or equal to 70 μm to 200 μm is necessary. Since carbon fillers of this length do not enter the small tooth tips of the wheels which are less than or equal to 0.3 mm, for example, in the wheels which are used in a timepiece, there is a problem in that sufficient conductivity may not be obtained. In a thin wheel, the filler jams easily at the bases of the teeth and there is a problem in that the tooth tips may not be formed. In rendering the wheel conductive, in a case in which a carbon filler is doped with boron and the boron is dispersed in the resin material, since the volume resistivity of the boron is high, there is a problem in that sufficient conductivity may not be obtained and a sufficient static electricity prevention effect may not be exhibited. Since the boron mostly fills the tooth tips in this case, sufficient conductivity may not be obtained, particularly at the tooth tips.

In the present embodiment, by adopting the following configuration, it is possible to solve these problems.

As described earlier, the wheel main body 910A and the wheel main body 912A of the resin wheel 91 are covered by the covering layer 900. Specifically, as illustrated in FIG. 6, in the wheel main body 910A, each main surface 910B (the main surface of the small wheel 912 side) and a tooth surface 910C (the surface of the teeth 911 and the side surface of the wheel main body 910A) are covered by the covering layer 900, and in the wheel main body 912A, a main surface 912B and a tooth surface 912C (the surface of the teeth 913 and the side surface of the wheel main body 912A) are covered by the covering layer 900. The covering layer 900 is configured by a metal material and is conductive.

Here, as described earlier, the metal wheel 93 is electrically connected to the cathode or the anode of the battery 233 via the connecting unit 96 and the printed circuit board 23. The battery 233 has a sufficiently large electrostatic capacity with respect to the static electricity which is generated by the resin wheel 91 and the metal wheel 93. Therefore, it is possible to discharge the static electricity which is generated by the metal wheel 93.

Since a portion (the tooth surface 912C) of the wheel main body 912A of the small wheel 912 which comes into contact with the metal wheel 93 is covered by the covering layer 900, the small wheel 912 reaches a state in which the surface of the small wheel 912 is electrically connected to the battery 233 via the metal wheel 93, the connecting unit 96, and the printed circuit board 23.

As described above, in the train wheel unit 9, it is possible to perform the discharging of the small wheel 912 (the resin wheel 91) and the metal wheel 93 and it is possible to prevent the accumulation of static electricity in the resin wheel 91 and the metal wheel 93 and the occurrence of the problems which are described earlier.

Since the main surface 912B of the wheel main body 912A is covered by the covering layer 900, it is possible to more effectively discharge the small wheel 912.

In the wheel main body 910A of the large wheel 910, each of the main surfaces 910B (the main surface of the small wheel 912 side) and the tooth surface 910C (the surface of the teeth 911) are covered by the covering layer 900 and the wheel main body 910A is connected to the covering layer 900 of the small wheel 912. Therefore, the surface of the large wheel 910 reaches a state of being electrically connected to the metal wheel 93 via the covering layer 900. Accordingly, it is possible to more effectively discharge the large wheel 910 (the resin wheel 91).

Although not particularly limited, examples of the metal material which configures the covering layer 900 include a singular metal or an alloy of at least one type selected from copper, nickel, tin, chrome, cobalt, platinum, gold, molybdenum, and tantalum.

Among these, it is preferable that the singular metal or the alloy (for example, a nickel-phosphorus alloy or a nickel-boron alloy) contains materials selected from nickel, tin, and chrome. Accordingly, the metal material has excellent abrasion resistance while maintaining sufficient conductivity.

It is possible to form a film of the covering layer 900 using various plating methods such as electroplating and electroless plating, and vapor deposition methods such as various vapor phase film deposition methods and various liquid phase film deposition methods such as PVD methods (physical vapor phase film deposition), CVD methods (chemical vapor phase film deposition), and plasma polymerization methods.

Examples of PVD methods include vacuum deposition, sputtering, ion plating, and laser ablation. Among these, it is preferable to use the sputtering. Accordingly, it is possible to prevent the resin material which configures the wheel from unintentionally warping and it is possible to accurately form the covering layer 900 even if the wheel is comparatively light.

Examples of CVD methods include an ordinary pressure CVD method, an LP-CVD method (a CVD method which is performed under low pressure conditions), a plasma CVD method (a high-frequency plasma CVD method, an ECR plasma CVD method, or the like), a heat CVD method, and a light CVD method (a CVD method which uses light in reaction promotion), and among these, it is preferable to use the plasma CVD method or the light CVD method. Accordingly, it is possible to prevent the resin material which configures the wheel from unintentionally warping due to heat.

Ina case in which the plating is used, in particular, the electroless plating is used, a process increasing the adherence to the covering layer 900 may be performed on the surfaces of the wheel main body 910A and the wheel main body 912A. Examples of this process include blasting (surface roughening), a washing process such as alkaline washing, acid washing, aqueous washing, organic solvent washing, and bombarding, etching processes such as a light reforming method which uses a permanganate salt solution method and titanium oxide, a catalytic process, and an accelerator process.

In a case in which the wheel main body 910A and the wheel main body 912A are configured by polyacetal, for example, which has a smaller surface tension than the surface tension of a plating liquid, it is desirable that the wheel main body 910A and the wheel main body 912A are subjected to corona treatment to improve the plating adherence properties.

It is preferable for the sheet resistance (surface electrical resistance) of the covering layer 900 to be less than or equal to $10^9$ Ω/sq and it is more preferable for the sheet resistance to be less than or equal to $10^7$ Ω/sq. Accordingly, the effect of the present embodiment may be more notably obtained.

Although, the thickness of the covering layer 900 is not particularly limited, a thickness in the range of 0.01 μm to 0.5 μm is preferable and a thickness in the range of 0.02 μm to 0.2 μm is more preferable. Accordingly, it is possible to secure sufficient conductivity and it is possible to prevent the meshing between the teeth 913 and the teeth 931 from being impeded. It is possible to perform the film forming process in a comparatively short time.

In a case of a wheel which has a comparatively fast rotational frequency, a plurality of methods from among the various plating methods and the various vapor deposition methods may be performed sequentially to increase the thickness of the covering layer 900.

In this manner, in the train wheel unit 9, the small wheel 912 meshes with the metal wheel 93. The small wheel 912 is covered by the covering layer 900 which is provided on the tooth surface 910C of the teeth 913 meshed with the teeth 931 of the metal wheel 93. The small wheel 912 is an example of the first wheel and the metal wheel 93 is an example of the second wheel.

In a case in which the small wheel 912 which includes the wheel main body 912A which is configured by the resin material and the metal wheel 93 mesh with each other, although static electricity is easily generated in the small wheel 912, even in this case, the effect of the present embodiment is more effectively exhibited.

The covering layer 900 is provided on the main surface 910B of the wheel main body 910A and the main surface 912B of the wheel main body 912A. Accordingly, it is possible to effectively discharge still more static electricity which is generated by the large wheel 910 and the small wheel 912.

In the train wheel unit 9, the large wheel 910 meshes with the rotor wheel 81 which is fixed to the rotating axle of the electric motor module 8. Accordingly, the large wheel 910 is lightened and it is possible to suppress the moment of inertia of the large wheel 910. Furthermore, the rotor wheel 81 is configured by a metal material and a configuration is adopted in which static electricity is easily accumulated in the large wheel 910. Therefore, the effect of the present embodiment is more effectively exhibited. The large wheel 910 is an example of the first wheel.

As described earlier, the train wheel unit 9 drives the second hand (the hand 411) of the timepiece and the second hand is fixed to the metal wheel 93 (the second wheel). In the train wheel unit 9 of the drive mechanism 22A which drives the second hand, a configuration is adopted in which the rotation speeds of the resin wheel 91 and the metal wheel 93 are comparatively fast and static electricity is easily accumulated. Therefore, the effect of the present embodiment is more effectively exhibited.

The metal wheel 93 is positioned closer to the following side than the large wheel 910 and the small wheel 912, that is, on a distal side of the electric motor module 8. In this configuration, although the metal wheel 93 is easily influenced by the torque from the hand 411, since the metal wheel 93 is configured by a metal material, the strength is high and the resilience is excellent.

In the present embodiment, in the train wheel unit 9 of all of the drive mechanisms 22A to 22F, since the resin wheel 91 is conductive, it is possible to obtain the effect in all of the drive mechanisms 22A to 22F.

In the present embodiment, although a description is given of a case in which the connecting unit 96 is connected to the end surface of the pointer axle 41, the configuration is not limited thereto, and the connecting unit 96 may be connected to at least one of the resin wheel 91 and the metal wheel 93, for example.

In the present embodiment, the cathode or the anode of the battery 233 is used as the reference electrode which is connected by the connecting unit 96. However, the configuration is not limited thereto as long as the electrostatic capacity is sufficiently large with respect to the static electricity which is generated in the wheels, for example, the connecting unit 96 may be connected to the external case 11. In this case, the printed circuit board 23 may be included inside the conductive path.

As described above, according to the present embodiment, the train wheel unit 9 is provided with the large wheel 910 which includes the wheel main body 910A and the covering layer 900 (the metal layer), the small wheel 912 which includes the wheel main body 912A and the covering layer 900, and the metal wheel. The wheel main body 910A is configured by the resin material, the covering layer 900 is configured by the metal material and covers at least a portion of the outer surface of the wheel main body 910A, the wheel main body 912A is configured by the resin material, the covering layer 900 is configured by the metal material and covers at least a portion of the outer surface of the wheel main body 912A, the metal wheel is configured by the metal material, and the train wheel unit 9 transmits the drive force of an electric motor module which uses a battery as the electrical power source.

In this configuration, it is possible to effectively secure the conductivity of the large wheel 910 or the small wheel 912 using a simple configuration in which the covering layer which is configured by the metal material is provided. The large wheel 910 and the small wheel 912 have the same potential as the metal wheel 93 and not only is charging caused by friction and separation prevented, it is also possible to prevent the generation of a Johnson Rahbeck force and a gradient force in the resin wheel 91, the metal wheel 93, and the train wheel bridge 94.

Since the large wheel 910, the small wheel 912, and the metal wheel 93 are connected to the cathode or the anode of the battery 233 by the pointer axle 41 and the connecting unit 96 and the potential is stable, it is possible to prevent the occurrence of problems caused by the sticking of the resin wheel 91 and the metal wheel 93.

The electronic timepiece 10 is provided with the movement 2 and the housing 1 (the casing) which stores the movement 2. Accordingly, the electronic timepiece 10 which exhibits the effect may be obtained.

In the present embodiment, although a description is given of the configuration in which the wheel main body 910A and the wheel main body 912A are covered by the covering layer 900, the configuration is not limited thereto and only one of the wheel main body 910A and the wheel main body 912A may be covered by the covering layer 900.

In the wheel main body 910A, as long as at least a portion of each of the main surfaces 910B (the main surface of the small wheel 912 side) and the tooth surface 910C is covered by the covering layer 900, the effect of the present embodiment may be obtained. In the wheel main body 912A, as long as at least a portion of the main surface 912B and the tooth surface 912C is covered by the covering layer 900, the effect of the present embodiment may be obtained.

In the wheel main body 910A, the covering of one of the main surfaces 910B by the covering layer 900 may be omitted. In this case, in a case in which vapor deposition is used to form a film of the covering layer 900, the effect of the present embodiment may be obtained by placing the wheel main body 910A on a placement surface and performing the vapor deposition. In other words, it is possible to omit the work in which the wheel main body 910A is placed on the placement surface, the vapor deposition is performed, the wheel main body 910A is inverted (the surface which is in contact with the placement surface is exposed), and the vapor deposition is performed again. Accordingly, it is possible to obtain a simplification of the film forming process.

In the present embodiment, although a case is described in which the large wheel 910 and the small wheel 912 are formed integrally in the resin wheel 91, the configuration is not limited thereto, and the large wheel 910 and the small wheel 912 may be configured separately with the separate parts bonded (for example, adhered, fused, or press-fitted) to each other. In this case, a portion of the large wheel 910 and the small wheel 912 may be configured by a metal material.

In the train wheel unit 9, an intermediate wheel may be present between the resin wheel 91 and the metal wheel 93. It is preferable that the teeth of the intermediate wheel are also covered by the covering layer which is configured by the metal material. In other words, the train wheel unit 9 may include a plurality of the first wheels which mesh with each other.

In this case, by connecting one of the resin wheel 91 and the intermediate wheel to a structural body which has a sufficiently great electrostatic capacity such as the battery 233, for example, it is possible to perform the discharging of both the resin wheel 91 and the intermediate wheel.

In the intermediate wheel, at least a portion of the tooth surface may be covered by the conductive covering layer, or alternatively, the entire surface of the teeth may be covered by the covering layer. In the intermediate wheel, at least one surface of the main surface of the intermediate wheel may be covered by the covering layer, or alternatively, the both main surfaces of the intermediate wheel may be covered by the covering layer.

In the present embodiment, although a description is given of the electronic timepiece 10 which uses the solar cell 5 for the electrical power generating function, the configuration is not limited thereto, and for the electrical power generating function, an oscillating weight may be used and the configuration may simply use the battery 233 which does not include an electrical power generating function.

Second Embodiment

Figure 7:
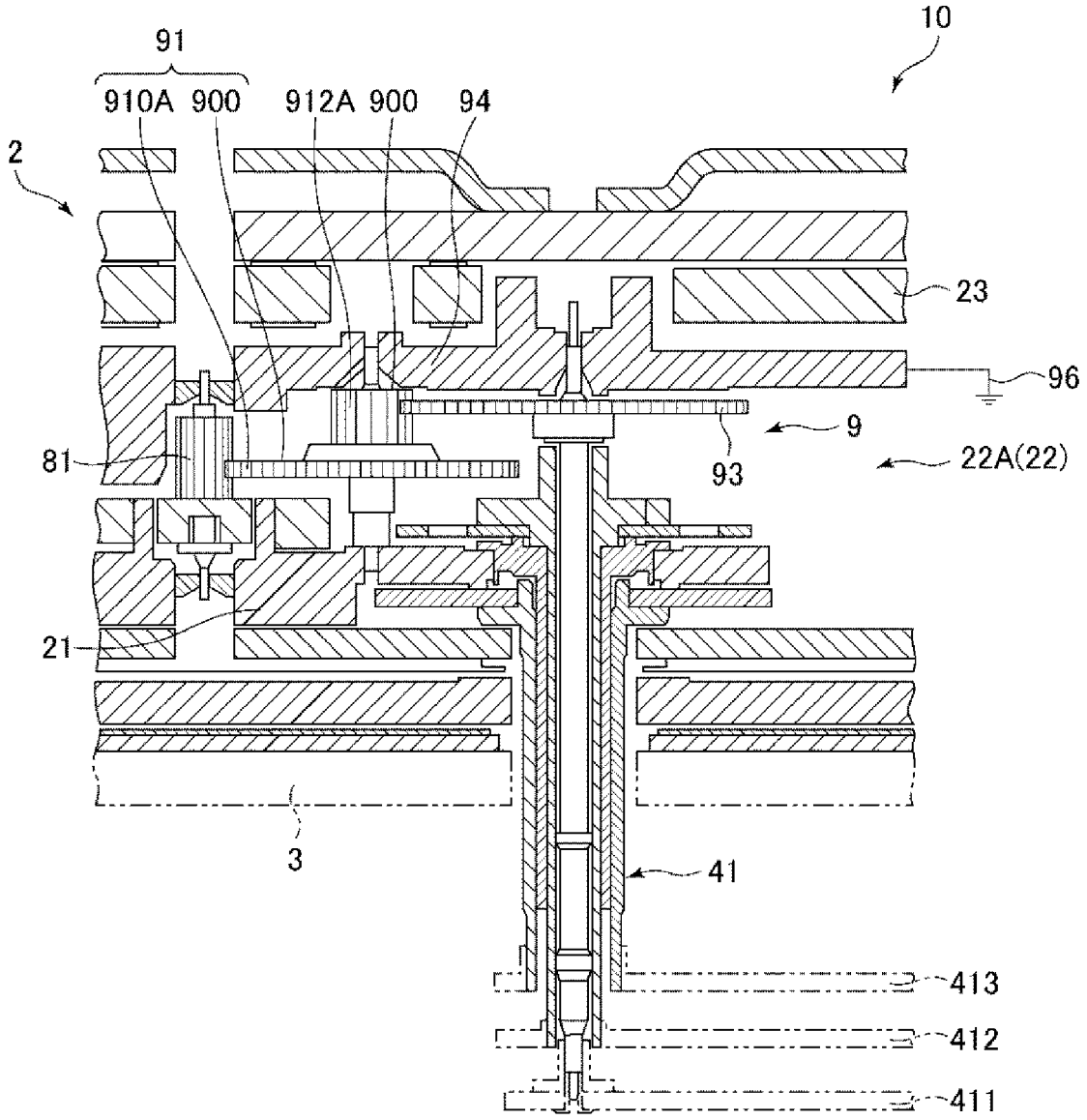
FIG. 7 is an enlarged sectional diagram of a movement of a second embodiment.

FIG. 7 is an enlarged sectional diagram of a movement of a second embodiment.

Hereinafter, a description will be given of the second embodiment of the movement and the timepiece according to the invention with reference to the drawings and the description will be given centered on the points which differ from the first embodiment, omitting the description of items which are the same.

The present embodiment is the same as the first embodiment except in that the train wheel bridge is conductive and the configuration of the connecting unit is different.

As illustrated in FIG. 7, since the resin wheel 91 is capable of movement in the axial direction, the resin wheel 91 comes into contact with and separates from the train wheel bridge 94. Therefore, the opposing surfaces of the train wheel bridge 94 with the resin wheel 91 and the metal wheel 93 become charged, a Coulomb force is generated, and the resin wheel 91 and the metal wheel 93 stick to the train wheel bridge 94. As a result, a frictional resistance is generated between the resin wheel 91 and the train wheel bridge 94 and problems occur that the rotation of the resin wheel 91 and the metal wheel 93 is impeded. The resin wheel 91 is an example of the first wheel and the metal wheel 93 is an example of the second wheel.

As described in the first embodiment, in the resin wheel 91, the wheel main body 910A and the wheel main body 912A are covered by the covering layer 900.

In the present embodiment, the train wheel bridge 94 is also conductive. The train wheel bridge 94 is configured by a material including a resin material and a carbon filler or a metal in minute fiber form. Accordingly, the train wheel bridge 94 has excellent lightweight properties, abrasion resistance, and shock resistance while maintaining sufficient conductivity.

Examples of the resin material include polyacetal, polycarbonate, polyamide, polyarylate, polyetherimide, and acrylonitrile-butadiene-styrene copolymer. Examples of the carbon filler include carbon powder, carbon fibers, and carbon nanotubes. Examples of fiber-form metals include copper, stainless steel, and metalized fibers in which glass fibers or needle-shaped ceramics are coated with aluminum or copper.

As illustrated in FIG. 6, in the present embodiment, the train wheel bridge 94 is connected to the cathode or the anode of the battery 233 (not illustrated) by the connecting unit 96. In the present embodiment, the connecting unit 96 is configured by conductive wire or the like, for example.

According to this configuration, the resin wheel 91, the metal wheel 93, and the train wheel bridge 94 have the same potentials and not only is charging caused by friction and separation prevented, it is also possible to prevent the generation of a Coulomb force, a Johnson Rahbeck force, and a gradient force in the resin wheel 91, the metal wheel 93, and the train wheel bridge 94. It is possible to connect the resin wheel 91 and the metal wheel 93 which are in contact with the train wheel bridge 94 to the cathode or the anode of the battery 233 using the train wheel bridge 94 and the connecting unit 96 without connecting the resin wheel 91 and the metal wheel 93 to the pointer axle 41 using a complex shape such as a long plate spring structure in the connecting unit 96, and since the potential is stabilized, it is possible to prevent problems which are caused by the sticking of the wheels. It is possible to omit a structure which connects the connecting unit 96 to the end surface of the axles of the wheels and the wheels are capable of rotating smoothly.

The surface of the train wheel bridge 94 may be covered by a covering layer which is configured by a material containing a conductive polymer or a metal material. Accordingly, it is possible to exhibit the effects.

The main plate 21 may also be conductive in the same manner as the train wheel bridge 94. Accordingly, it is possible to obtain the effect which is described above. In this case, only the main plate 21 may be conductive and the train wheel bridge 94 may be configured by a non-conductive material which is the same as that of the first embodiment. Alternatively, both the main plate 21 and the train wheel bridge 94 may be conductive.

Third Embodiment

Figure 8:
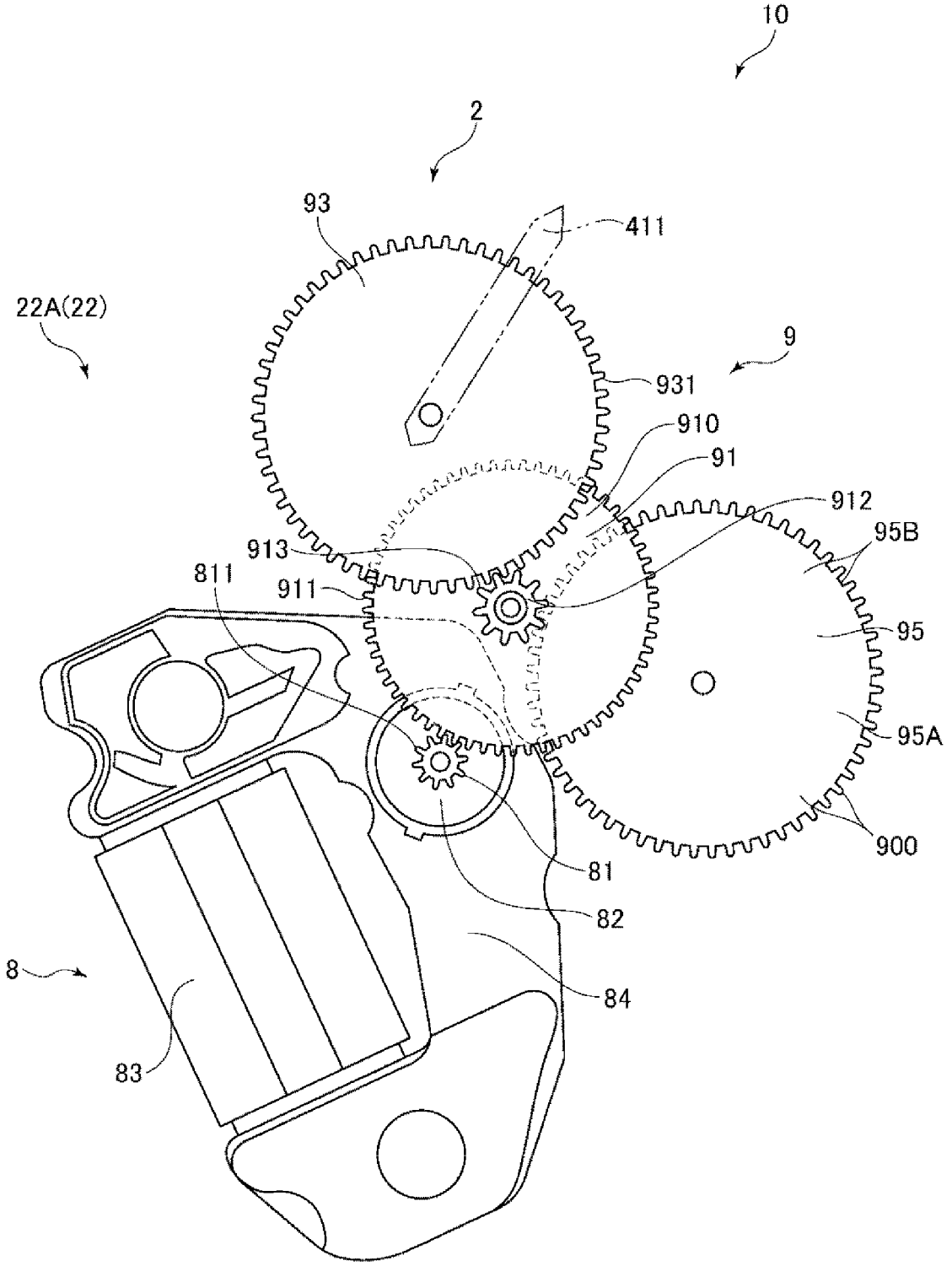
FIG. 8 is a schematic diagram (a sectional diagram) illustrating a train wheel unit of a third embodiment.

FIG. 8 is a schematic diagram (a sectional diagram) illustrating a train wheel unit of a third embodiment.

Hereinafter, a description will be given of the third embodiment of the movement and the timepiece according to the invention with reference to the drawings and the description will be given centered on the points which differ from the embodiments described earlier, omitting the description of items which are the same.

The present embodiment is the same as the first embodiment except that the configuration of the train wheel unit is different.

As illustrated in FIG. 8, in the present embodiment, the train wheel unit 9 includes a detecting wheel 95 (a second detecting wheel) which meshes with the small wheel 912 of the resin wheel 91. The detecting wheel 95 includes the same number of teeth as that of the metal wheel 93 and rotates at the same rotational period as that of the metal wheel 93.

Through-holes are formed in each of the large wheel 910 and the detecting wheel 95 and the through-hole of the detecting wheel 95 and the through-hole of the large wheel 910 are formed to overlap in plan view at one location in the span of a single rotation of the detecting wheel 95. A light sensor printed circuit board (not illustrated) is disposed between the detecting wheel 95 and the resin wheel 91 and the main plate 21, and a light emitting element such as a light emitting diode (LED), a light emitting polymer (OLED), or an inorganic EL is provided on the light sensor printed circuit board at the same position as the position at which the through-holes overlap in plan view. A light receiving element such as a photo-diode, a photo-transistor, or cadmium sulfide cell (Cds) is provided on the printed circuit board 23 at the same position as the position at which the through-holes overlap in plan view. It is possible to detect that the hand 411 is positioned at a reference position due to the light from the light emitting element passing through the overlapping through-holes and being detected by the light receiving element.

The detecting wheel 95 includes a wheel main body 95A and a covering layer 95B which covers the surface (the tooth surface and the main surfaces) of the wheel main body 95A. The detecting wheel 95 is an example of the first wheel. As described in the first embodiment, the covering layer 95B is configured by a metal material. Accordingly, for example, it is possible to electrically connect the detecting wheel 95 to the metal wheel 93 via the resin wheel 91 without connecting a wiring to the rotating axle (center axis) of the detecting wheel 95 and it is possible to electrically connect the detecting wheel 95 to the cathode or the anode of the battery 233. As a result, it is possible to perform the discharging of the detecting wheel 95 and it is possible to prevent the accumulation of static electricity in the detecting wheel 95 and the occurrence of the problems which are described earlier.

Hereinabove, although a description is given of the movement and the timepiece according to the invention using the embodiments of the drawings, the invention is not limited thereto, and it is possible to replace the parts which configure the movement and the timepiece with parts of any configuration that may exhibit similar functions. Any other constituent parts may be added.

Although a description is given of a wristwatch type timepiece as an example of the electronic timepiece in the embodiments, the invention is not limited thereto, and it is also possible to apply the invention to clocks, pendant type timepieces, pocket watches, and the like, for example.

The train wheel unit of the present embodiment is not limited to an electronic timepiece, and, for example, it is possible to apply the train wheel unit to wearable terminals such as smart glasses, smartphones, tablet terminals, or head-mounted displays (HMD), car navigation devices, electronic diaries (including those equipped with communication functions), electronic dictionaries, calculators, electronic gaming devices, word processors, videophones, security TV monitors, electronic binoculars, POS terminals, medical devices (for example, electronic thermometers, blood pressure meters, blood glucose meters, electrocardiographic devices, ultrasonic diagnostic equipment, and electronic endoscopes), fish finders, various measurement instruments, gages (for example, gages of vehicles, airplanes, and boats), flight simulators, and the like.

The entire disclosure of Japanese Patent Application No. 2018-033846, filed Feb. 27, 2018 is expressly incorporated by reference herein.

What is claimed is:

1. A movement comprising:

an electric motor module configured to be driven by electrical power from a battery;

a first wheel configured to transmit a drive force of the electric motor module, the first wheel including:

a wheel main body being resin; and a metal layer which is provided on a surface of the wheel main body; and a second wheel configured to transmit the drive force of the electric motor module, the second wheel being metal, wherein the first wheel is meshingly engaged with the second wheel, the wheel main body includes teeth, and the metal layer is provided on a tooth surface of the teeth.

2. The movement according to claim 1, further comprising:

a conductive train wheel bridge which supports the first wheel and the second wheel.

3. The movement according to claim 1, further comprising:

a conductive main plate which supports the first wheel and the second wheel.

4. The movement according to claim 1, wherein the metal material includes a material selected from nickel, tin, and chrome.

5. The movement according to claim 1, wherein the wheel main body includes a main surface, and wherein the metal layer is provided on the main surface of the wheel main body.

6. The movement according to claim 1, wherein the first wheel is meshingly engaged with a wheel which is fixed to a rotating axle of the electric motor module.

7. The movement according to claim 1, wherein the movement includes a plurality of the first wheels meshingly engaged with each other.

8. The movement according to claim 1, wherein the second wheel is positioned on a distal side of the electric motor module.

9. The movement according to claim 1, wherein a second hand is fixed to the second wheel.

10. A timepiece comprising:

an electric motor module configured to be driven by electrical power from a battery;

a first wheel configured to be transmit a drive force of the electric motor module, the first wheel including:

a wheel main body being resin, and a metal layer which is provided on a surface of the wheel main body;

a second wheel configured to transmit a drive force of the electric motor module, and the second wheel being metal; and a casing which stores the battery, the electric motor module, the first wheel, and the second wheel, wherein the first wheel is meshingly engaged with the second wheel, the wheel main body includes teeth, and the metal layer is provided on a tooth surface of the teeth.

* * * * *